United States Patent [19]

McKay et al.

[11] Patent Number: 4,731,042

[45] Date of Patent: Mar. 15, 1988

[54] SNARE TOY AND METHOD OF CAPTURING A TOY VICTIM

[75] Inventors: Robert S. McKay, 7420 Beckwith Rd., Morton Grove, Ill. 60053; Steven S. Starr, Chicago; William D. Nelson, Elgin, both of Ill.

[73] Assignee: Robert S. McKay, Wood Dale, Ill.

[21] Appl. No.: 928,016

[22] Filed: Nov. 7, 1986

[51] Int. Cl.[4] ..... A63H 33/00; A63H 3/36; A01K 71/00; B65D 33/24

[52] U.S. Cl. ..... 446/309; 446/475; 446/486; 446/489; 43/102; 383/43; 383/117

[58] Field of Search ..... 446/286, 308, 309, 312, 446/330, 368, 475, 486, 489; 383/43, 117; 128/303 A; 150/52 R; 43/102, 105

[56] References Cited

U.S. PATENT DOCUMENTS

| | | | |
|---|---|---|---|
| 645,890 | 3/1900 | Conrad | 47/21 |
| 1,820,040 | 8/1931 | Zuckerman | 47/28 |
| 2,723,481 | 11/1955 | Schwartz | 43/7 |
| 2,731,054 | 1/1956 | Driben | 383/43 |
| 3,168,209 | 2/1965 | Brookins et al. | 383/43 |
| 4,267,839 | 5/1981 | Laufe et al. | 128/303 A |
| 4,374,523 | 2/1983 | Yoon | 128/303 A |
| 4,524,457 | 6/1985 | Marino | 383/117 |
| 4,639,234 | 1/1987 | Atwood | 446/486 |

*Primary Examiner*—Robert A. Hafer

*Assistant Examiner*—Charles H. Harris

*Attorney, Agent, or Firm*—Robert V. Jambor

[57] ABSTRACT

The disclosed toy may be used for capturing an intended toy victim within a snare net sufficiently large when opened to fit over and around at least part of the victim. A carrier, shaped as a monstrous insect or the like, may be used for holding the net open while stalking the victim, for positioning the net over and down around the victim, and for releasing the net when desired to snare the victim. The carrier may have a body and a plurality of legs depending from the body in an array to fit at least partially down and around the victim. Corresponding free ends of the legs have means for receiving and removably holding the snare net, to hold the same opened. The net may be elongated and generally tubular in shape, having a closed end and an open end. Flexible elastic means at the open net end, may be stretched to the holding means on the legs; and when released, may resiliently close the open net end against and relative to the victim. Each leg may have a stationary portion and a movable portion, extended side-by-side. The stationary leg portions may receive and removably hold the net, and the movable leg portions may disengage the net from the stationary leg portions. A release button may be manually activated to shift the movable leg portions relative to the stationary leg portions, to release the net from the legs.

16 Claims, 9 Drawing Figures

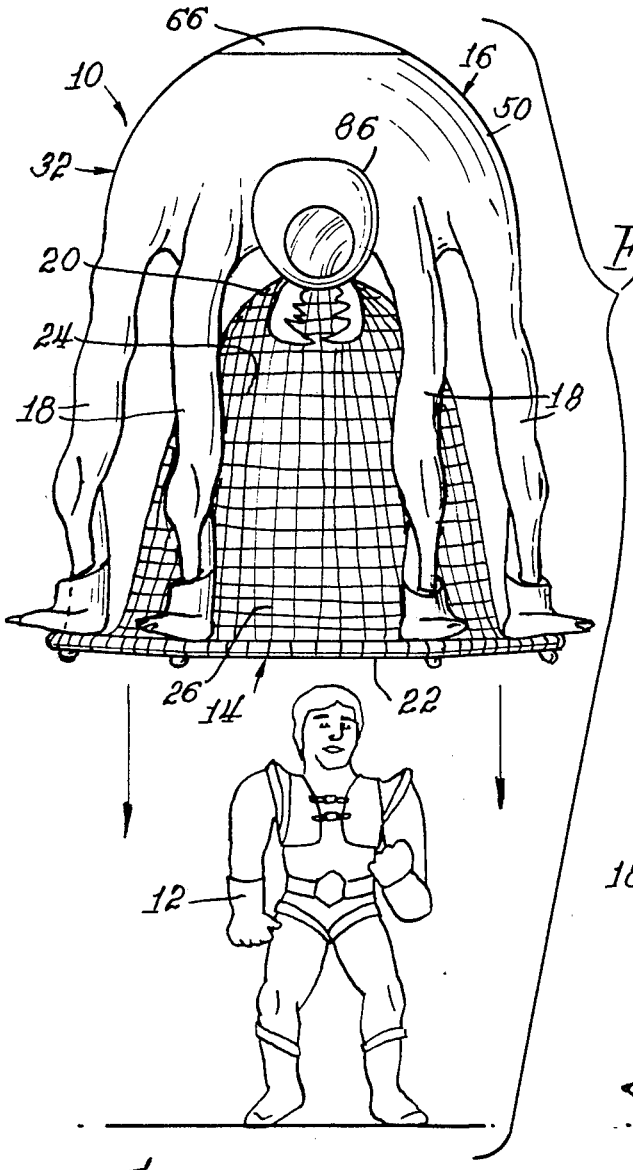
Fig. 1.
Fig. 7.
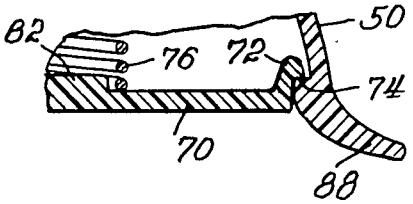
Fig. 2.
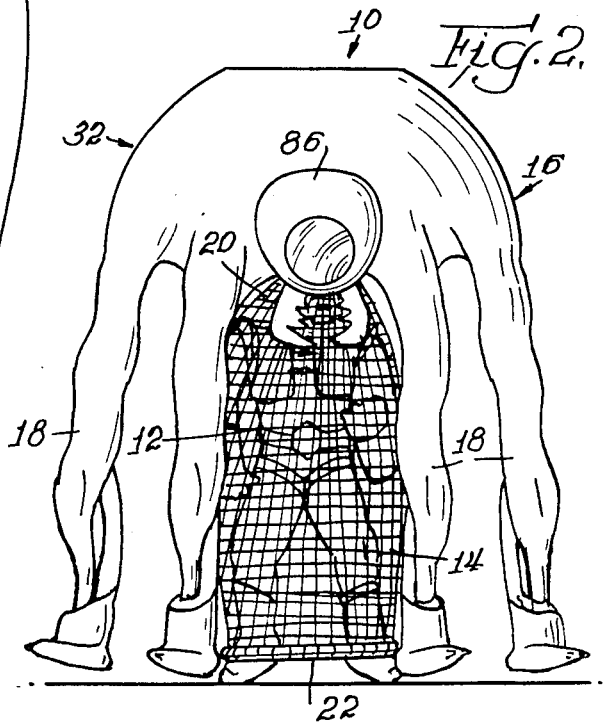
Fig. 3
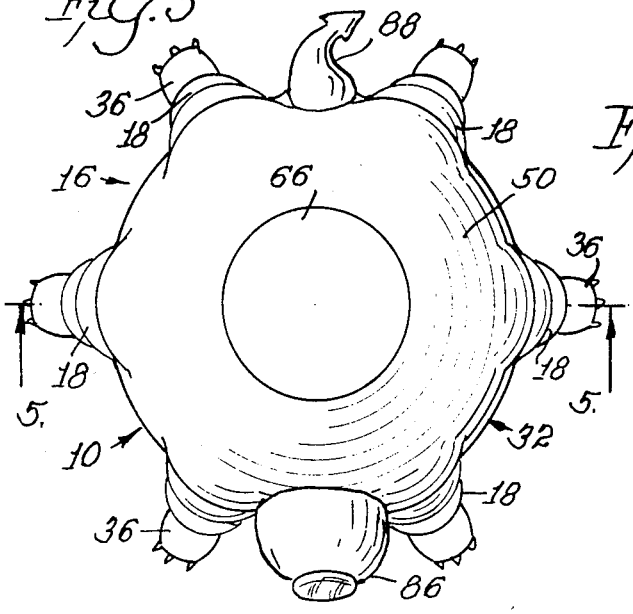
Fig. 4
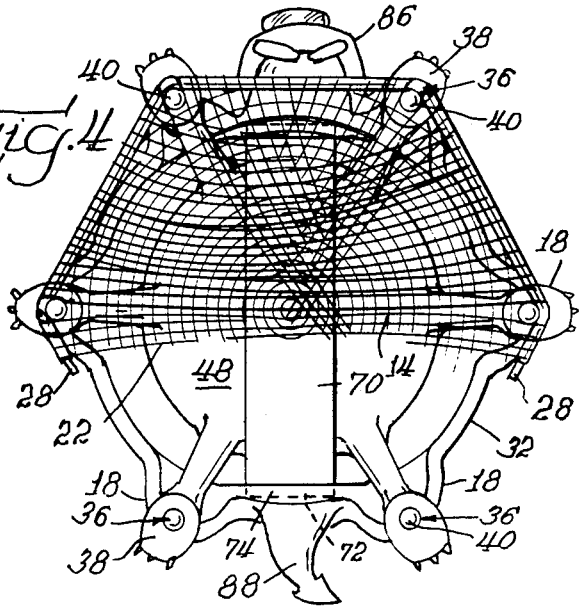

66
68
60
32
16
54
62
56
58
64
50
48
80
7
76
36
74
82
70
20
88
7
18
26
84
42
44
42
44
28
28
40
40
14
22
24
84
38
9
9
36
42
44
40
66
68
60
50
16
56
62
60
48
80
64
76
38
72
74
82
70
88
36
38
84
84
84
84
44
36
38
8
9
9
38
38
36
36
44
42
42
8
40
44
44
40

SNARE TOY AND METHOD OF CAPTURING A TOY VICTIM

BACKGROUND OF THE INVENTION

It has long been common to capture prey (insects, animals and humans) with snare nets. Such nets are generally formed of flexible fabric material; strong enough to hold the captured victim, but soft enough not to harm the victim, should the health and safety of the victim be of concern . . . such as in a zoological hunt. In some instances, the net is suspended between and by stationary framing members; and the prey comes to within the range of the net, whereupon the net is released to enclose the victim. In other instances, the framing members for suspending the net are moved about, after the victim, in the form of a stalk and hunt; and again when the prey is within the range of the net, the net is moved to enclose the victim.

Capture games and toys have long had appeal also, especially those that use action characters and/or devices, and require or offer some action, such as stalking, chasing, and/or capturing an intended victim.

SUMMARY OF THE INVENTION

This invention relates to a capture toy; having a snare net that can be located over, and brought down around the intended victim, for the capture; and further having a carrier device for holding the snare net open and in proper position for stalking the victim and moving the net down around the victim, and also for releasing the net when desired to entrap the intended victim within the net.

The snare net, in an open condition, is intended to fit over at least part of the intended victim, and the carrier for holding the net, has a body and a plurality of legs depending downwardly from the body and arranged in an array spaced apart sufficiently to fit at least partially down around the intended victim. The free ends of the legs have means thereon for receiving and removably holding the snare net; and means may controllably release the snare net from the holding means on the carrier legs.

The snare net is formed of flexible fabric having an open weave; and is elongated and generally tubular in shape, having an open end and a closed end. The closed net end is adapted to be located within the spaced array of the legs and adjacent the toy body, and the open net end is adapted to be held relative to the free leg ends.

Elastic means at the open net end, stretch to allow the open net end to be fitted onto the holding means at the free leg ends, and when released from the holding means, snap the open net end closed against and relative to the intended victim.

BRIEF DESCRIPTION OF THE DRAWINGS

FIG. 1 is an elevational view of operating carrier and net components of the invention, showing the same as positioned, during stalking, vertically above an intended victim.

FIG. 2 is an elevational view of the operating components of the invention, similar to FIG. 1, except showing the carrier and net components positioned after the capture of the intended victim, with the net released to entrap the victim.

FIG. 3 is a top view of the carrier of FIG. 1.

FIG. 4 is a bottom view of the carrier of FIG. 1, except showing the same with portions of the net broken away and not in place, for clarity of disclosure.

FIG. 7 is a fragmentary sectional view, taken generally from line 7—7 in FIG. 5.

DETAILED DESCRIPTION OF AN ILLUSTRATED EMBODIMENT

Figures 5, 6, 8, 9:
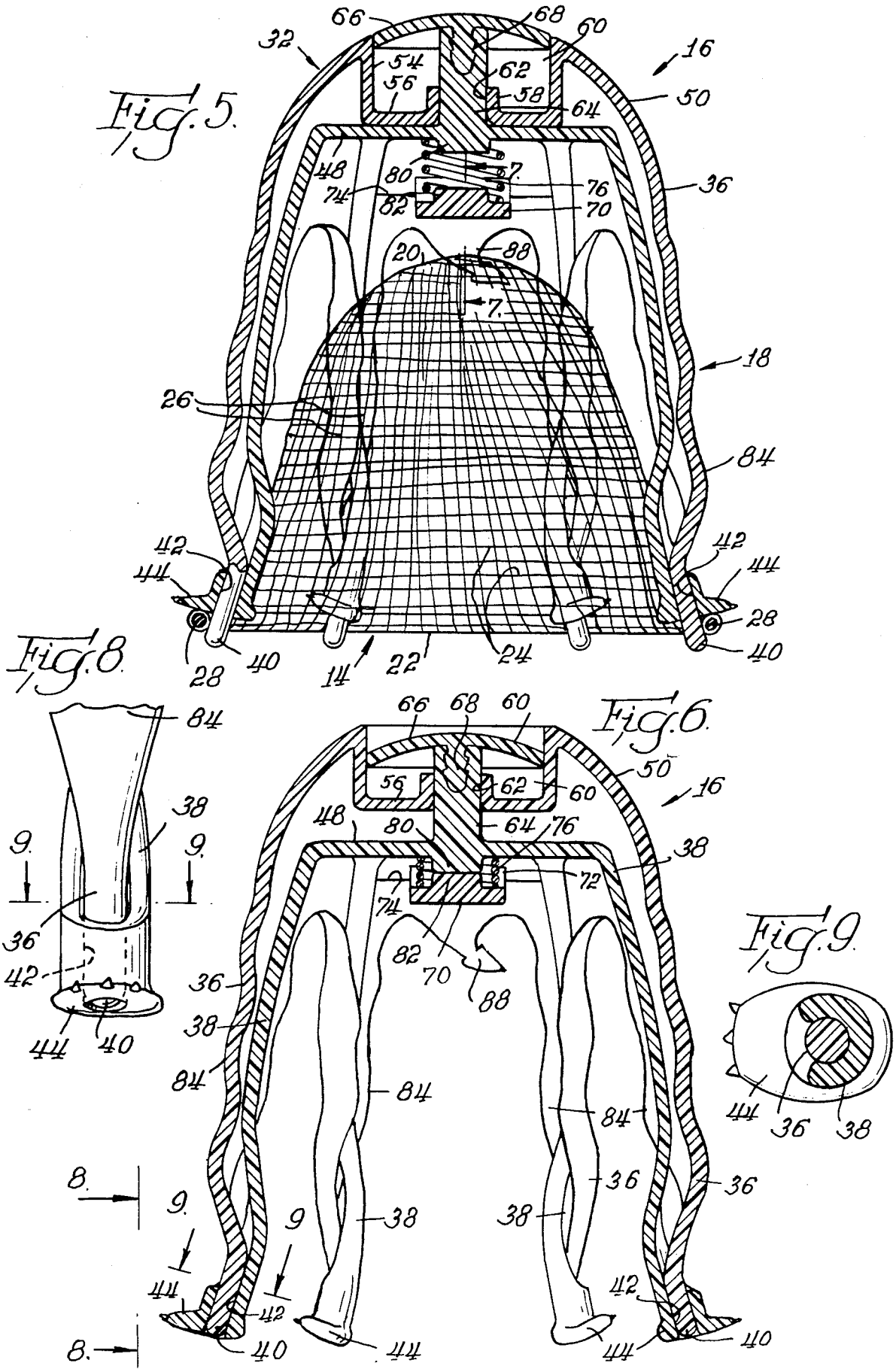
FIG. 5 is an enlarged sectional view, taken generally along line 5—5 in FIG. 3, showing the net in place on the carrier, in the stalking position of FIG. 1.
FIG. 6 is an enlarged sectional view, similar to FIG. 5, except showing the carrier in the net-releasing position of FIG. 2, and without the net, for clarity of disclosure.
FIG. 8 is a fragmentary elevational view, taken generally from line 8—8 in FIG. 6.
FIG. 9 is a sectional view, taken generally from line 9—9 in FIG. 8.

FIGS. 1 and 2 show a toy 10 that may be used for capturing an intended toy victim 12 within a snare net 14, that when opened may be fitted at least partly down around the victim 12. A carrier 16, shaped as a monstrous insect, for example, having an array of legs 18, may be used for holding the net 14 opened (see FIG. 1), relative to the victim 12, for positioning the net 14 over and bringing it down around the victim, and for releasing it when desired to snare the victim 12 within the net (see FIG. 2).

The net 14 (see FIGS. 1, 2 and 5) may be elongated and generally tubular in shape, somewhat like a sock, having a closed end 20 and having an open end 22. The net 14 may be formed of a flexible fabric, with an open weave having spaced lateral strands 24 and spaced longitudinal strands 26. This provides an appearance similar to an open weave snare net (not shown) commonly associated with trapping big game animals, or the like. Flexible elastic means 28 may be secured within or formed as part of the net 14, at the open net end 22, to allow the open net end 22 to be stretched and fitted onto the free ends of the spaced carrier legs 18 (see FIGS. 1 and 5). When released, the elastic means 28 retract under its resiliency and may close the open net end 22 against and relative to the victim (as illustrated in FIG. 2).

The carrier 16 may have a body 32, and the spaced legs 18 may depend, at corresponding ends, from the body 32. Each leg 18 of the array (see FIGS. 5 and 6) has a substantially stationary portion 36 and a movable portion 38, extended in side-by-side relation, with the free end 40 of the stationary leg portion 36 extended through, and beyond, an opening 42 in the free end 44 of the movable leg portion 38. As illustrated, the stationary leg portions 36 are radially outward of the movable leg portions 38, throughout most of their lengths, except where they cross at the openings 42.

The opposite upper ends of the separate stationary and movable leg portions 36 and 38 respectively are common, being interconnected to one another. Thus, a body member 48 may interconnect the upper ends of the inner movable leg portions 38, the body member 48 being generally flat and disposed transverse to the leg portions. A body member 50 may interconnect the upper ends of the outer stationary leg portions 36, the body member 50 being generally rounded and curved to blend smoothly into the leg portions, as the body and legs of an insect or the like might so blend. The body member 50, connected to the stationary leg portions 36 may also be considered as stationary; and the body member 48, connected to the movable leg portions 38, may also be considered as movable.

The movable body member 48 is connected relative to the stationary body member 50, to allow limited axial movement of the stationary and movable leg portions (36 and 38) relative to one another. To provide for this connection, the stationary body member 50 may be shaped to have a substantially cylindrical wall section 54, a transverse wall section 56, and a smaller substantially cylindrical guide section 58 across the top and center portion of the body member; defining a centered cylindrical cavity 60 in the normal exterior of the member, and a centered cylindrical guide opening 62. A post 64 may upstand from the movable body member 48, nornal to the flat of member; and may fit through the guide opening 62, to allow movement between these components axially of the post. A push button 66 sized to fit loosely within the cavity 60 may be secured to the post 64; as by a barbed projection 68 on the button 66 being pushed into an open bore in the upper end of post 64.

A cross bar 70 (see FIGS. 4, 5, 6 and 7) is designed to be joined to the stationary body member 50, in a crosswise orientation substantially parallel to the transverse wall section 56. To provide for this joined connection, the bar 70 may have spring tabs 72 on its opposite ends (only one of the ends being shown in FIG. 7), to be snapped past locking, to provide for this secured cooperation. Before the cross bar 70 and stationary body member 50 are secured together, helical compression spring 76 may be fitted initially between the cross bar 70 and the underside of the movable body member 48, annularly of guide seats 80 and 82 on the movable body member and cross bar respectively.

The stationary and movable portions 36 and 38 respectively of each leg 18 extend side-by-side: each stationary leg portion 36 being fixed relative to the stationary body member 50, and each movable leg portion 38 being fixed relative to the movable body member 48 and to the release button 66 supported within cavity 60. The spring 76 tends to bias the leg portions 36 and 38 to the net-holding and/or stalking position of FIGS. 1 and 5; where the movable body member 48 is against the transverse wall section 56, and the stationary leg ends 40 are projected and exposed below the movable leg ends 44.

The ends 40 of the stationary leg portions 36 are angled radially outwardly for a short distance relative to the length of the legs, to provide that they together define outwardly angled hook-like projections about or around the open end 22 of the snare net may be positioned; and the resiliency of the open net end 22 may provide sufficient tension against the projected ends, so that with these angled leg ends and some friction between these components, the open net end may be reliably and firmly held relative to such leg ends 40.

Manual depression of the release button 66, against the resiliency of the spring 76, may axially shift the stationary and movable leg portions 36 and 38 respectively, to the net-release position of FIGS. 2 and 6; where the ends of the guide seats 80 and 82 butt against one another, and the stationary leg ends 40 are confined totally within the movable leg ends 44. The free end 44 of each movable leg portion is angled radially outwardly for a short distance relative to the length of the leg, at an angle transverse to, or even normal to, the adjacent free end 40 of the stationary leg portion. This and defines a large underside that may be moved against the open net end 22, to move the same axially along the projected ends 40 of the stationary leg portions, as such ends 44 are moved relative to and on the stationary ends 40.

When the elastic means 28 of the open net end 22 is no longer constrained on the leg ends 40, the net 14 releases from the carrier 16 and the open end 22 of the net is allowed to snap closed.

The projected free ends 40 of the stationary leg portions 36 provide the means for receiving and removably holding the open end 22 of the snare net 14, and the movable leg portions 38 to provide the means at the free ends 44 for disengaging the snare net 14 from the holding means on the legs. The cooperating sliding fit of each stationary leg end 40 within the opening 42 of the movable leg end 44 also ties the ends together laterally of these paired leg portions, but allows axial movement between such leg portions.

The legs 18 are generally stiff against compression in the axial direction; but being elongated axially, can be flexed somewhat laterally outward, should such be needed as the legs 18 are being brought down around the intended victim 12.

Six legs 18 are illustrated, at approximately equal spacings or angles (60 degrees) from one aother; and are flared out slightly from the body, to have the array define an upside-down cup or slightly conical configuration, that may easily fit over and surround the victim. Variations are possible, such as using four or eight equally spaced legs; or using four, six or eight legs, where the spacing or alignment between adjacent legs need not be the same. As illustrated, the length of the legs may correspond somewhat to the cross dimension of the array.

The stationary body member 50 and the stationary leg portions 36 are disposed outwardly of the movable body member 48 and the movable leg portions 38. For added realism, the exterior of such stationary body member 50, release button 66, and leg portions 36 may have a scale or skin effect, both in texture and color, to simulate more exactly the insect, or whatever other like monster or creature might be selected for the toy body. Also, somewhat bowed contours and widened sections 84 may be made in the stationary leg portions 36 to simulate joints in such legs 18. The legs ends 44 may be contoured, and claws may even be provided on the tips, to provide the appearance of feet at the ends of the legs. A head 86 may project from the body 32, having realistic markings and/or openings for a mouth and/or pinchers and/or eyes or the like; and a tail 88 may project from the body 32 opposite the head 86.

The toy victim 12 illustrated resembles a human, but such victim could be a toy animal; a make-believe toy character, such as a space person; or an inanamate toy object, such as a truck or the like.

As noted, the closed net end 20 will fit within the array of spaced carrier legs 18, next to the carrier body 32; and the open net end 22 will be releasably secured relative to the free leg ends 40. As the holding means at the leg ends 40 are near the bottom of the toy 10, the toy may be lowered down around the victim 12, until the legs almost contact the surface on which the victim is supported; so that the released net end 22 may snap closed at or closely adjacent the bottom or lowest portion of the victim to almost totally enclose the victim.

The separate stationary and movable components may be fabricated of molded plastic pieces, providing the leg portions 36 and 38 are integral with the respective body members 50 and 48. The stationary body 50 may be small enough to be gripped in one's hand, such as between 3 and 6 inches across; the legs may be so spaced accordingly at the body, and be angled outwardly slightly to even a larger open dimension at the free ends; and the legs may be of related lengths.

The user of the toy 10 may thus manipulate the toy about with one hand, holding onto the stationary body member 50, during stalking of the victim 12. When the stalk is over, the carrier 16, with the net 14 held thereon, may be lowered down around the victim 12 as far as the relative sizes may allow or until the free ends of the legs approach the surface supporting the victim. The release button 66 may then be depressed with either the index finger of the hand holding the toy 10, or by any finger or thumb of the other hand, to disengage the net 14, so that the same may close about the victim 12.

Although the invention has been described with respect to the illustrated embodiment, it should be understood that the invention is not limited to such embodiment. Modifications and/or additions may be made by those skilled in the art, without departing from the scope of the invention defined by the appended claims.

What we claim as our invention is:

1. A method of capturing an intended toy victim, comprising the steps of providing a snare net large enough in an opened condition to fit over at least part of the intended victim, and in a closed position to fit at least partially over and around the intended victim;

loading the snare net on a carrier having a body and a plurality of legs depending downwardly from the body, the legs being arranged in an array spaced apart sufficiently to fit over and at least partially down around the intended victim, and the net being held in the opened condition on the ends of the legs remote from the body;

stalking the victim by moving the carrier, with the net thereon, to a position vertically over the intended victim;

moving the carrier, with the net thereon, downwardly to a position with the carrier legs and net at least partially around the intended victim; and releasing the snare net from the free ends of the carrier legs to allow it to shift to the closed position over the victim.

2. A method of capturing an intended toy victim, according to claim 1, comprising further that the snare net is formed of a flexible pervious fabric and is elongated and generally tubular in shape, having an open end and a closed end, and of locating the closed net end within the array of legs next to the carrier body, and of securing the open net end releasably relative to the remote leg ends.

3. A method of capturing an intended toy victim, according to claim 2, comprising further the flexible elastic means forms part of the open net end, and of stretching the open net end over the remote leg ends of the carrier, and of allowing the open net end when released therefrom to close against and relative to the intended victim.

4. A toy for capturing an intended toy victim, comprising the combination of a structural carrier having a body and a plurality of legs depending downwardly from the body and spaced apart in a somewhat annularly arranged array sized to fit at least partially down and around the intended victim;

an elongated generally flexible tubular snare net having an open end and a closed end;

said snare net being sized in an open condition, to fit over at least part of the intended victim, and being formed of an open weave pervious fabric;

said snare net also being adapted in the opened condition to fit within the array of spaced carrier legs, with the closed net end being located next to the carrier body, and the open net end being located next to the ends of the legs remote from the carrier body;

means near said remote ends of the carrier legs for holding spaced regions of the snare net proximate the open net end, in order to hold the snare net in the open condition and relative to the carrier; and means to release the snare net from the holding means on the legs, said release means being manually controlled from proximate the carrier body.

5. A capture toy as claimed in claim 4, further including flexible elastic means forming part of the open net end, the elastic means being adapted to allow the open net end to be secured relative to the holding means at the remote leg ends, but being adapted when released from the holding means, to at least partially move the open net end closed against and relative to the intended victim.

6. A capture toy as claimed in claim 4, wherein each leg is formed as a substantially stationary leg portion and as a movable leg portion, the same being extended somewhat in side-by-side relation, each stationary leg portion being fixed relative to the carrier body, and each movable leg portion being fixed relative to the controlled release means.

7. A capture toy as claimed in claim 6, wherein the stationary leg portions extend between the carrier body and the remote leg ends and have free ends angled radially outwardly for short distances and at slight angles relative to remainder of the legs, and said free ends of the stationary leg portions providing the means for removably holding the spaced regions of the snare net.

8. A capture toy as claimed in claim 7, wherein the open net end is adapted to be extended around said free ends of said stationary leg portions and to lie over the radially outward side of each of said free ends, providing the means for removably holding the spaced regions of the snare net.

9. A capture toy as claimed in claim 8, wherein the movable leg portions extend from near the carrier body to near the free ends of the stationary leg portions, and the movable leg portions near the free ends of the stationary leg portions being angled radially outwardly for a short distance relative to said free ends, providing the means for engaging the snare net to release it from the holding means on the stationary leg portions.

10. A capture toy as claimed in claim 7, wherein each stationary leg portion extends in side-by-side outwardly adjacent relationship relative to a respectively paired movable leg portion, from the carrier body to near the free end thereof, said leg portions crossing one another near the remote ends, and means cooperating where the leg portions cross for allowing axial movement of the stationary and movable leg portions relative to one another to effect the release of the snare net, and for holding the stationary and movable leg portions laterally together at such locations.

11. A capture toy as claimed in claim 10, wherein a member integral with each of the stationary leg portions fixes each statonary leg portion relative to, and defines the exterior of, the carrier body; and a member integral with each of the movable leg portions fixes each movable leg portion relative to the controlled release means; and means connecting the members together, allowing limited relative movement therebetween in the direction of the leg portions.

12. A capture toy as claimed in claim 11, wherein the controlled release means includes a release element supported on the movable member and exposed through an opening in the stationary member, adapted to be manually depressed to shift the members and the leg portions axially relative to one another.

13. A capture toy as claimed in claim 12, further includes a spring disposed between the stationary and movable members, operable to shift them to a relative position where the free ends of the stationary leg portions are exposed.

14. A capture toy as claimed in claim 13, wherein the open net end is adapted to be extended around said free ends of said stationary leg portions and to lie over the radially outward side of each of said free ends, providing the means for removably holding the spaced regions of the snare net.

15. A capture toy as claimed in claim 14, wherein the movable leg portions extend from near the carrier body to near the free ends of the stationary leg portions, and the movable leg portions near the free ends of the stationary leg portions being angled radially outwardly for a short distance relative to said free ends, providing the means for engaging the snare net to release it from the holding means on the stationary leg portions.

16. A capture toy as claimed in claim 15, further wherein the stationary and movable leg portions are generally stiff in the axial direction of the legs but allow some outward lateral deflection of the remote leg ends, as such legs may be placed down around the intended victim.

* * * * *